US009411320B1

(12) United States Patent
Liang et al.

(10) Patent No.: US 9,411,320 B1
(45) Date of Patent: Aug. 9, 2016

(54) INTELLIGENT WATCH

(71) Applicant: Quanta Computer Inc., Taoyuan (TW)

(72) Inventors: Yuan-Chen Liang, Taoyuan (TW); Cheng-Hao Wu, Taoyuan (TW); Ya-Chu Chuang, Taoyuan (TW); Chi-Cheng Wu, Taoyuan (TW); Hsuan-Hao Hsu, Taoyuan (TW)

(73) Assignee: QUANTA COMPUTER INC., Taoyuan (TW)

( * ) Notice: Subject to any disclaimer, the term of this patent is extended or adjusted under 35 U.S.C. 154(b) by 0 days.

(21) Appl. No.: 14/918,075

(22) Filed: Oct. 20, 2015

(30) Foreign Application Priority Data

Jul. 23, 2015 (TW) ..... 104211905

(51) Int. Cl.
*G04G 21/00* (2010.01)
*G04G 9/00* (2006.01)

(52) U.S. Cl.
CPC . *G04G 21/00* (2013.01); *G04G 9/00* (2013.01)

(58) Field of Classification Search
CPC ..... G04G 17/08; G04G 21/08; G04G 21/00; G04C 3/005; G06F 1/163; G06F 3/0362; G04B 9/00
USPC ..... 200/61.56, 223
See application file for complete search history.

(56) References Cited

U.S. PATENT DOCUMENTS

| | | | | |
|---|---|---|---|---|
| 4,678,344 | A * | 7/1987 | Inoue | G04C 3/005 368/10 |
| 6,556,222 | B1 * | 4/2003 | Narayanaswami | G04C 9/0064 368/295 |
| 6,575,618 | B1 * | 6/2003 | Inoue | G01D 5/2451 250/231.13 |
| 7,874,722 | B2 * | 1/2011 | Clarkson | G04B 37/1486 368/281 |
| 8,001,488 | B1 * | 8/2011 | Lam | G06F 3/0238 345/156 |
| 8,511,890 | B2 * | 8/2013 | Andren | G04B 19/283 368/187 |
| 2002/0101457 | A1 * | 8/2002 | Lang | G06F 1/163 715/856 |
| 2003/0070106 | A1 * | 4/2003 | Kosuda | G06F 1/06 713/500 |
| 2006/0151982 | A1 * | 7/2006 | Mills | A61G 5/045 280/755 |

* cited by examiner

*Primary Examiner* — Sean Kayes
(74) *Attorney, Agent, or Firm* — Rabin & Berdo, P.C.

(57) ABSTRACT

An intelligent watch includes a main body, a trigger switch, an inner-ring body and an outer-ring body. The trigger switch is disposed in the main body. The inner-ring body is pressably engaged on the main body to be pressed for trigger the trigger switch. The outer-ring body is rotatably engaged on the main body and surrounds the inner-ring body.

8 Claims, 4 Drawing Sheets

INTELLIGENT WATCH

RELATED APPLICATIONS

This application claims priority to Taiwan Application Serial Number 104211905, filed Jul. 23, 2015, which is herein incorporated by reference.

BACKGROUND

1. Field of Disclosure

The present disclosure relates to a watch. More particularly, the present disclosure relates to an intelligent watch.

2. Description of Related Art

With the development of electronic and wireless communication technology, an electronic device is integrated with a typical wearable unit to form a wearable electronic device (e.g., intelligent watch) for being worn on a user's body or carried by a user. Such a wearable electronic device exchanges electric data or signals with an external device.

An intelligent watch is provided with decorative parts (e.g., watch straps or a bezel) that a traditional watch normally has. However, such decorative parts are merely used for beautifying the appearance of the wearable electronic device, rather than providing functional applications that have their basis in sound ideas and creativity.

Therefore, ways in which to provide a solution to effectively solve the aforementioned inconvenience and shortages and to increase the competitiveness of industries will be seriously concerned.

SUMMARY

An aspect of the disclosure is to provide an intelligent watch to overcome the defects and inconvenience of the prior art.

According to one embodiment, the intelligent watch includes a main body, a display module, at least one trigger switch, an inner-ring body and an outer-ring body. The display module is disposed on the main body. The trigger switch is disposed in the main body. The inner-ring body is pressably engaged on a surface of the main body for being pressed to trigger the trigger switch. The outer-ring body is rotatably engaged on the surface of the main body, and surrounds the inner-ring body and the display module.

Therefore, when a user presses the inner-ring body to trigger the trigger switch under the inner-ring body, a control signal of the triggered switch is generated for controlling the intelligent watch. As an end result of such functionality, users are motivated to purchase and use the intelligent watch.

In one or more embodiments, when a user presses the inner-ring body down, the pressing direction that the inner-ring body is pressed is parallel with a normal line of a display surface of the display module. Also, when a user rotates the outer-ring body, the outer-ring body rotates about the normal line.

In one or more embodiments, the intelligent watch further comprises a detection circuit. The detection circuit is disposed in the main body, and is aligned with the outer-ring body for detecting the rotation of the outer-ring body and correspondingly generating at least one control signals in accordance with the degree of rotation of the outer-ring body. Thus, when a user rotates the outer-ring body, the detection circuit can detect the rotation of the outer-ring body and correspondingly generate control signals in accordance with the degree of rotation of the outer-ring body.

In one or more embodiments, the main body includes a casing, a first ringed protrusion, a second ringed protrusion and a waterproof washer. The first ringed protrusion is disposed on one side of the casing, and surrounds the display module. The second ringed protrusion is disposed on the side of the casing, and surrounds the first ringed protrusion and the display module. The waterproof washer is seamlessly sandwiched between the first ringed protrusion and the second ringed protrusion, surrounds the first ringed protrusion, and contacts with the inner-ring body and the trigger switch. Thus, the outer-ring body is rotatably engaged on the second ringed protrusion, and covers one side of the inner-ring body.

In one or more embodiments, the casing, the first ringed protrusion, the second ringed protrusion and the waterproof washer are integrally formed, wherein the hardness of the casing, the hardness of the first ringed protrusion and the hardness of the second ringed protrusion are the same, and the hardness of the waterproof washer is lower than the hardness of the second ringed protrusion.

In one or more embodiments, the second ringed protrusion is provided with a flange, and the outer-ring body is provided with a recess. The flange is slidably engaged with the recess, such that the outer-ring body is rotatably engaged on the second ringed protrusion.

In one or more embodiments, one protruding rim of the inner-ring body extends above the first ringed protrusion and a gap is formed between the protruding rim of the inner-ring body and the first ringed protrusion.

It is to be understood that both the foregoing general description and the following detailed description are by examples, and are intended to provide further explanation of the disclosure as claimed.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure. In the drawings.

DESCRIPTION OF THE EMBODIMENTS

Figure 1:
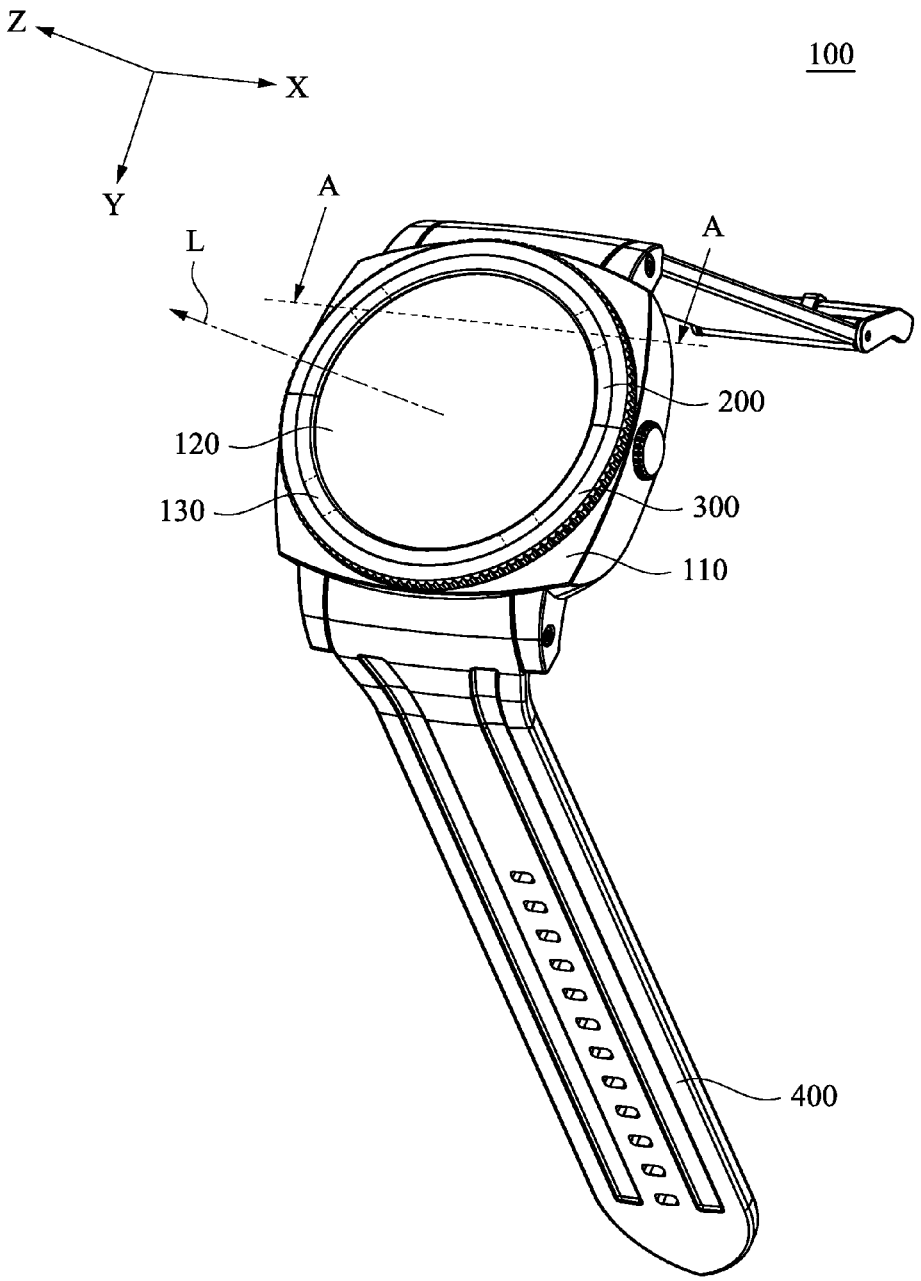
FIG. 1 is a perspective view of an intelligent watch according to one embodiment of this disclosure.

Reference will now be made in detail to the present embodiments of the disclosure, examples of which are illustrated in the accompanying drawings. Wherever possible, the same reference numbers are used in the drawings and the description to refer to the same or like parts. According to the embodiments, it will be apparent to those skilled in the art that various modifications and variations can be made to the structure of the present disclosure without departing from the scope or spirit of the disclosure.

As used herein, "around," "about," or "approximately" shall generally mean within 20 percent, preferably within 10 percent, and more preferably within 5 percent of a given value or range. Numerical quantities given herein are approximate, meaning that the term "around," "about," or "approximately" can be inferred if not expressly stated.

Figure 2:
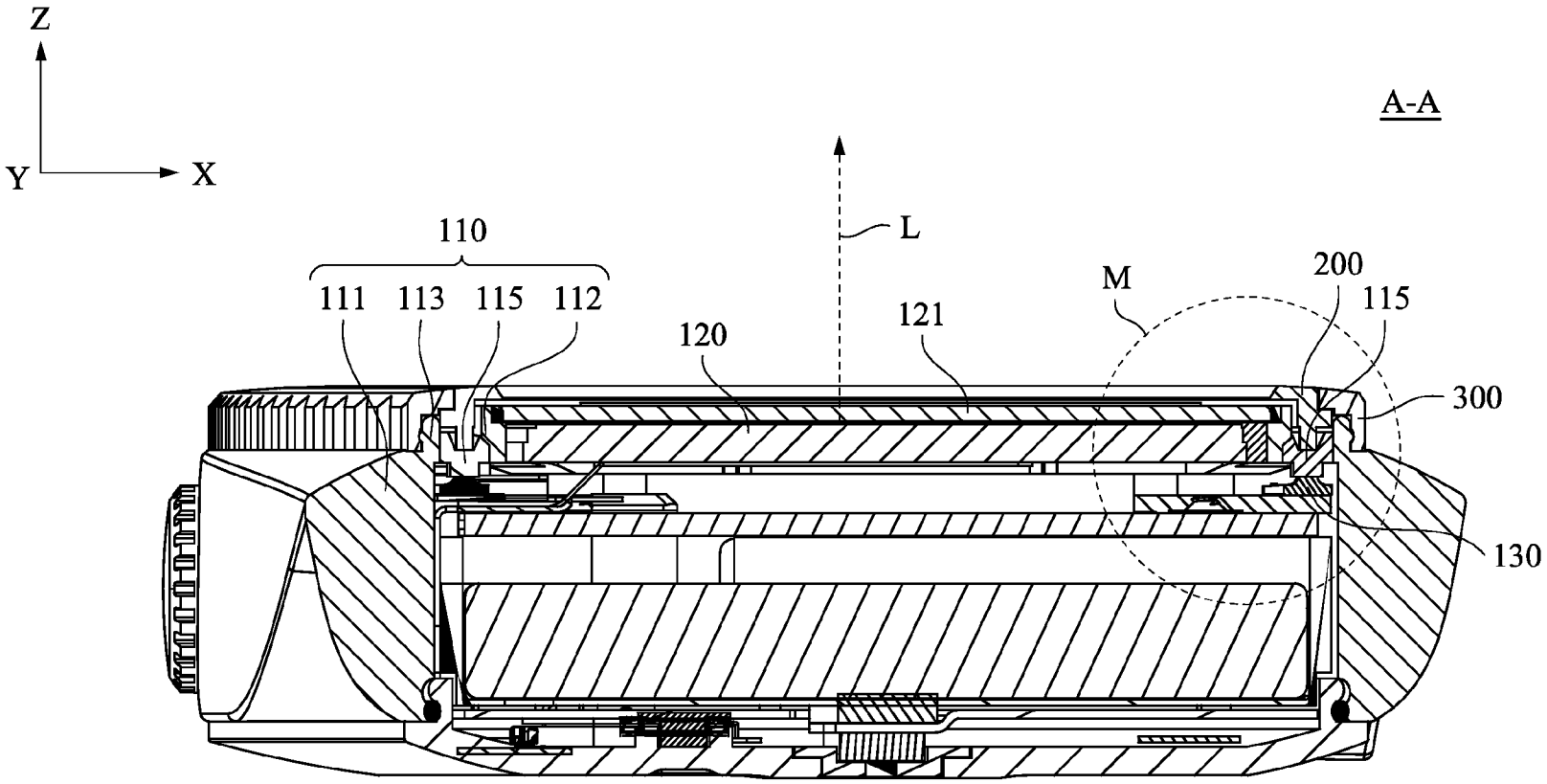
FIG. 2 is a cross sectional view of the intelligent watch taken along line A-A of FIG. 1.

FIG. 1 is a perspective view of an intelligent watch according to one embodiment of this disclosure, and FIG. 2 is a cross sectional view of the intelligent watch taken along line A-A of FIG. 1. As shown in FIG. 1 and FIG. 2, the intelligent watch 100 includes a main body 110, a display module 120, trigger switches 130, an inner-ring body 200, an outer-ring body 300 and a wear unit 400 (e.g., watch straps). The wear unit 400 is connected to the main body 110. For example, the wear unit 400 is detachably assembled to the main body 110. The display module 120 is disposed in the main body 110, and a display surface of the display module 120 is exposed so as to be viewable from outside the main body 110. The trigger switches 130 are disposed in the main body 110. The inner-ring body 200 is pressably engaged on a surface of the main body 110, thus, the inner-ring body 200 can be pressed against to trigger one of the trigger switches 130. Thus, when the inner-ring body 200 is pressed down, a pressing direction (e.g., along Z axis) that the inner-ring body 200 is pressed is parallel, or substantially parallel with a normal line L (i.e., Z axis) of the display surface of the display module 120. The outer-ring body 300 is rotatably engaged on the surface of the main body 110, and surrounds the inner-ring body 200 and the display module 120. Thus, when the outer-ring body 300 is rotated, the outer-ring body 300 rotates about the normal line L of the display surface.

The intelligent watch 100 is able to link with a smart electric device (not shown) for mutually exchanging electric data or signals. Therefore, when a user presses a region of the inner-ring body 200 against one of the trigger switches 130 to trigger the trigger switch 130, a corresponding control signal can be generated for controlling the intelligent watch 100 or the smart electric device linked thereto. As an end result of such a function, users are motivated to purchase and use the intelligent watch 100.

Figure 3:
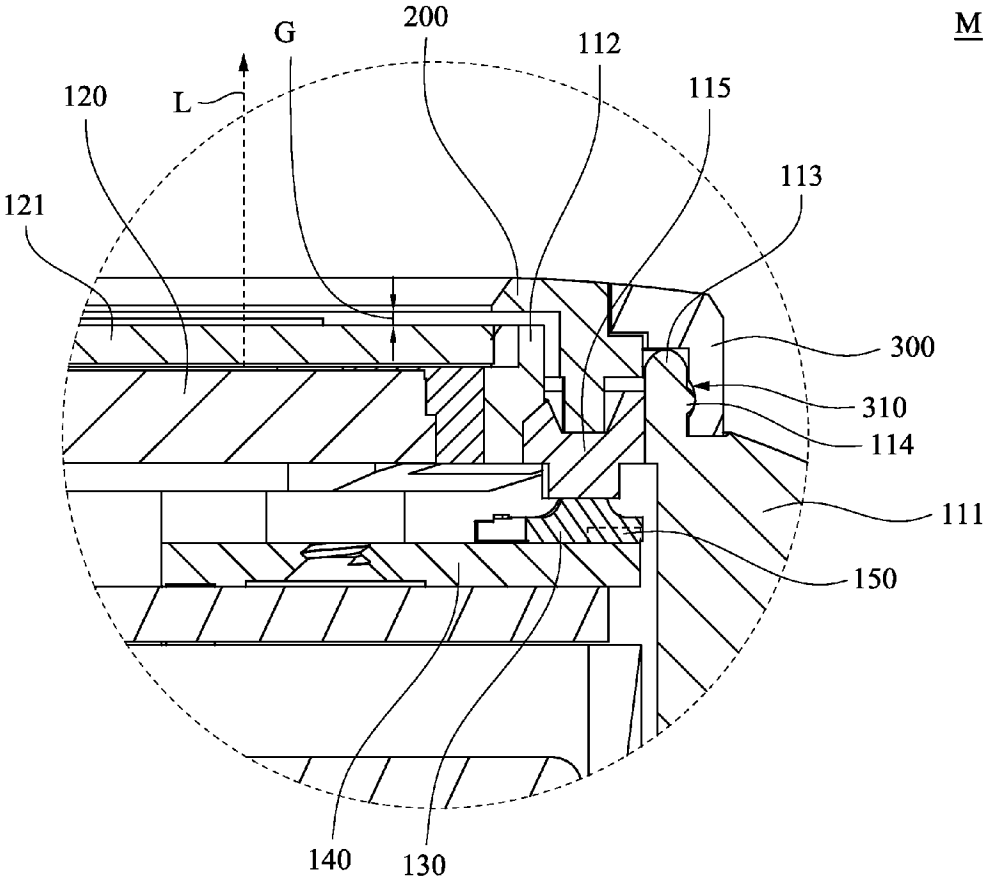
FIG. 3 is an enlarged view of a zone M of FIG. 2.

FIG. 3 is an enlarged view of a zone M of FIG. 2. As shown in FIG. 3, in greater detail, the main body 110 includes a casing 111, a first ringed protrusion 112, a second ringed protrusion 113 and a waterproof washer 115. The first ringed protrusion 112 is formed on one side of the casing 111, and totally surrounds the display module 120. The second ringed protrusion 113 is formed on the side of the main body 110, and totally surrounds the first ringed protrusion 112, the waterproof washer 115 and the display module 120. The outer-ring body 300 is rotatably engaged on the second ringed protrusion 113.

The waterproof washer 115 is waterproof and elastic. The waterproof washer 115 is seamlessly and continually connected to the first ringed protrusion 112 and the second ringed protrusion 113, so that the waterproof washer 115 is seamlessly and continually sandwiched between the first ringed protrusion 112 and the second ringed protrusion 113. The waterproof washer 115 totally surrounds the first ringed protrusion 112 and the display module 120 therein, so as to block the flow of air entering through the waterproof washer 115. Also, the waterproof washer 115 can support the inner-ring body 200. Thus, when the inner-ring body 200 is disposed between the first ringed protrusion 112 and the second ringed protrusion 113, and abuts against the waterproof washer 115, through the rotatable coupling of the outer-ring body 300 on the second ringed protrusion 113 and the covering of one side of the inner-ring body 200 by the outer-ring body 300, the inner-ring body 200 is allowed to only move between the outer-ring body 300 and the waterproof washer 115, so as to avoid detaching from the intelligent watch 100.

Therefore, when one region of the inner-ring body 200 is pressed down, the inner-ring body 200 can indirectly press against one of the trigger switches 130 through the waterproof washer 115, in which the pressed trigger switch 130 exactly corresponds to the pressed region of the inner-ring body 200. After the inner-ring body 200 is released, the waterproof washer 115 returns the inner-ring body 200 back to its original position.

Also, since the waterproof washer 115 is seamlessly and continually sandwiched between the first ringed protrusion 112 and the second ringed protrusion 113, vapor or liquid will not permeate into the main body 110 via the position between the first ringed protrusion 112 and the second ringed protrusion 113, so as to lessen the possibility of damage to components inside the main body 110.

Furthermore, since the waterproof washer 115 is disposed between the inner-ring body 200 and the trigger switches 130, and directly contacts the inner-ring body 200 and the trigger switches 130, not only does the waterproof washer 115 provide a waterproofing function, but also absorbs excessive pressing force resulting from the inner-ring body 200 being excessively pressed against the waterproof washer 115. Hence, the waterproof washer 115 can protect the trigger switches 130 from being damaged.

Moreover, since one protruding rim of the inner-ring body 200 is extended above the first ringed protrusion 112, a gap G is formed between the inner-ring body 200 and the first ringed protrusion 112. The gap G is a pressing stroke that the inner-ring body 200 reaches the trigger switches 130. Thus, when the inner-ring body 200 indirectly presses against the trigger switch 130, the first ringed protrusion 112 appropriately contacts the inner-ring body 200 to stop the inner-ring body 200, so that the trigger switches 130 can be protected from damage.

Further, in this embodiment, since an outer side of the second ringed protrusion 113 is provided with a ringed flange 114, and an inner side of the outer-ring body 300 is provided with a ringed recess 310, by engaging the ringed flange 114 with the ringed recess 114, the outer-ring body 300 can be rotatably engaged on the second ringed protrusion 113.

In addition, the main body 110 is provided with a light-transmissive protective cover 121. The light-transmissive protective cover 121 is arranged on the display module 120, and is supported by the first ringed protrusion 112, so as to protect and shield the display module 120.

In one of the embodiments, the casing 111, the first ringed protrusion 112, the second ringed protrusion 113 and the waterproof washer 115 are integrally formed. More particularly, the casing 111, the first ringed protrusion 112, the second ringed protrusion 113 and the waterproof washer 115 are integrally formed through a double-injection-molding process. Thus, each of the casing 111, the first ringed protrusion 112 and the second ringed protrusion 113 respectively includes an identical first material, and the waterproof washer 115 includes a second material which is different from the first material, in which the hardness of the second material is lower than the hardness of the first material. However, it is noted that the disclosure is not limited thereto, and in another embodiment, designers may integrally form the waterproof washer 115 on the inner-ring body 200 through other methods.

The different kinds of the first material are not limited in the disclosure. For example, the first material may be a plastic material, In which the plastic material may be high-density polyethylene (PE), polypropylene (PP), acrylonitrile butadiene styrene (ABS), nylon or combinations thereof. Similarly, the different kinds of the second material are not limited in the disclosure. The second material may, for example, be a plastic material, such as low-density polyethylene (PE), thermoplastic elastomer (TPR), polyvinyl chloride (PVC), thermoplastic polyurethane (TPU), silicone rubber or combinations thereof.

Figure 4:
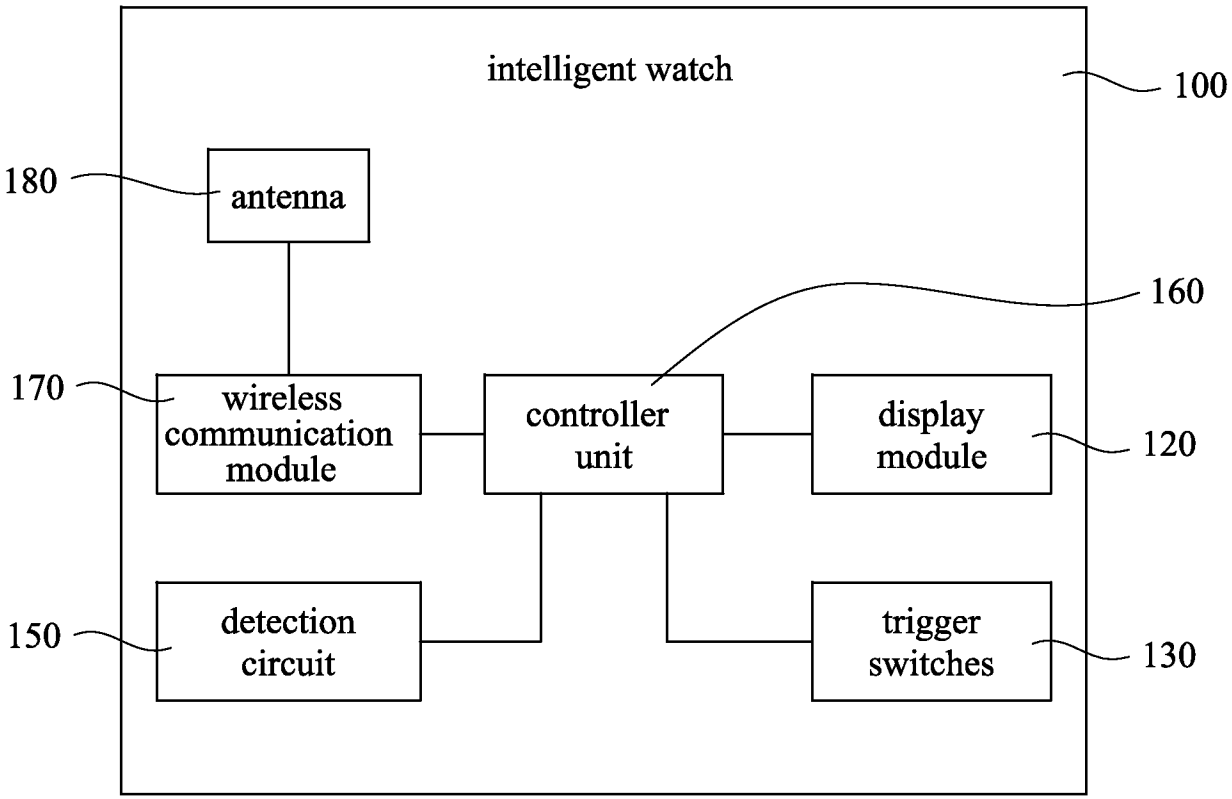
FIG. 4 is a block diagram of an intelligent watch according to an embodiment of this disclosure.

FIG. 4 is a block diagram of an intelligent watch 100 according to an embodiment of this disclosure. In one or more embodiments, as shown in FIG. 3 and FIG. 4, the intelligent watch 100 further includes a circuit board 140 (or printed circuit board), a detection circuit 150 and a controller unit 160. The detection circuit 150, for example, is an optical detection circuit. The detection circuit 150 is disposed in the casing 110 and exactly aligns with the outer-ring body 300. That is, an orthogonal projection of the detection circuit 150 projected along a normal line (axis Z) of the display surface of the display module 120 is exactly overlapped with the outer-ring body 300. Thus, when the user rotates the outer-ring body 300, the detection circuit 150 can detect the rotation of the outer-ring body 300 to correspondingly generate at least one control signal and transmit the same to the controller unit 160 in accordance with the degree of rotation of the outer-ring body 300, so as to control the intelligent watch 100 or the smart electric device which is linked to the intelligent watch 100. The detection circuit 150 and the trigger switches 130 are disposed on the circuit board 140, and the controller unit 160 is electrically connected to the detection circuit 150, the trigger switches 130 and the display module 120 via traces of the circuit board 140 for operating the intelligent watch 100 (e.g., controlling the display module 120) in accordance with the control signals which are sent from the detection circuit 150 or the trigger switches 130. For example, each of the aforementioned control signals can be used for adjusting display fonts, audio volumes or brightness of a backlight of the intelligent watch 100.

Furthermore, in addition to controlling the intelligent watch 100, the controller unit 160 also can control the smart electric device via the intelligent watch 100. The intelligent watch 100 further includes a wireless communication module 170 and an antenna 180. The wireless communication module 170 is electrically connected to the controller unit 160 and the antenna 180. Thus, when the user presses down the inner-ring body 200 or rotates the outer-ring body 300, the controller unit 160 wirelessly exchanges information with the smart electric device by the wireless communication module 170. For example, the controller unit 160 can perform a turn-page function with respect to information shown on the smart electric device, or a skip function with respect to music played on the smart electric device.

In the aforementioned embodiment, the wireless communication module is a Bluetooth® wireless communication module. However, the disclosure is not limited thereto, and in another embodiment, the wireless communication module also can be an infrared transmission module, a radio frequency identification (RFID) module, a WIFI network module or a near-field communication (NFC) module.

Although the present disclosure has been described in considerable detail with reference to certain embodiments thereof, other embodiments are possible. Therefore, the spirit and scope of the appended claims should not be limited to the description of the embodiments contained herein. It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims and their equivalents.

What is claimed is:

1. An intelligent watch comprising:

a main body;

a display module disposed on the main body;

at least one trigger switch disposed in the main body;

an inner-ring body pressably engaged on a surface of the main body for being pressed to trigger the trigger switch; and an outer-ring body rotatably engaged on the surface of the main body, and surrounding the inner-ring body and the display module.

2. The intelligent watch of claim 1, wherein the inner-ring body is restricted in movement between only the outer-ring body and the trigger switch.

3. The intelligent watch of claim 1, wherein the display module has a display surface, and a pressing direction of the inner-ring body is parallel with a normal line of the display surface, and the outer-ring body is allowed to rotate about the normal line.

4. The intelligent watch of claim 1 further comprising:

a detection circuit disposed in the main body, and aligned with the outer-ring body for detecting rotation of the outer-ring body and correspondingly generating at least one control signal in accordance with the degree of the rotation of the outer-ring body.

5. The intelligent watch of claim 1, wherein the main body comprises:

a casing;

a first ringed protrusion disposed on one side of the casing, and surrounding the display module;

a second ringed protrusion disposed on the side of the casing, and surrounding the first ringed protrusion and the display module; and a waterproof washer seamlessly sandwiched between the first ringed protrusion and the second ringed protrusion, the waterproof washer surrounding the first ringed protrusion, and contacting with the inner-ring body and the trigger switch, wherein the outer-ring body is rotatably engaged on the second ringed protrusion, and covers one side of the inner-ring body.

6. The intelligent watch of claim 5, wherein the casing, the first ringed protrusion, the second ringed protrusion and the waterproof washer are integrally formed, wherein the hardness of the casing, the hardness of the first ringed protrusion and the hardness of the second ringed protrusion are the same, and the hardness of the waterproof washer is lower than the hardness of the second ringed protrusion.

7. The intelligent watch of claim 5, wherein the second ringed protrusion is provided with a flange, and the outer-ring body is provided with a recess, wherein the flange is slidably engaged with the recess, such that the outer-ring body is rotatably engaged on the second ringed protrusion.

8. The intelligent watch of claim 5, wherein one protruding rim of the inner-ring body extends above the first ringed protrusion and a gap is formed between the protruding rim of the inner-ring body and the first ringed protrusion.

* * * * *